US007573471B2

(12) United States Patent
Park

(10) Patent No.: US 7,573,471 B2
(45) Date of Patent: Aug. 11, 2009

(54) ELECTRO-LUMINESCENCE DISPLAY

(75) Inventor: Jae Yong Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 1545 days.

(21) Appl. No.: 09/878,401

(22) Filed: Jun. 12, 2001

(65) Prior Publication Data

US 2001/0050663 A1 Dec. 13, 2001

(30) Foreign Application Priority Data

Jun. 12, 2000 (KR) ..... 2000-32078

(51) Int. Cl.
*G09G 5/00* (2006.01)

(52) U.S. Cl. ..... 345/205; 345/76; 345/206; 361/760

(58) Field of Classification Search ..... 345/204–206, 345/36, 45, 76–82; 359/237–254; 349/148–152; 315/169.1–169.3; 439/67; 361/760–767, 361/773–777
See application file for complete search history.

(56) References Cited

U.S. PATENT DOCUMENTS 5,754,171 A * 5/1998 Stoller ..... 345/205
5,893,623 A * 4/1999 Muramatsu ..... 349/152
5,907,375 A * 5/1999 Nishikawa et al. ..... 349/12
5,936,850 A * 8/1999 Takahashi et al. ..... 361/784
5,963,287 A * 10/1999 Asada et al. ..... 349/150
5,966,115 A * 10/1999 Aoki ..... 345/204
6,275,220 B1 * 8/2001 Nitta ..... 345/204
6,320,691 B1 * 11/2001 Ouchi et al. ..... 359/237
6,519,020 B1 * 2/2003 Cha et al. ..... 349/150
6,597,113 B1 * 7/2003 Nitta ..... 313/581
6,774,872 B1 * 8/2004 Kawada et al. ..... 345/60
2002/0067331 A1 * 6/2002 Takabayashi et al.
2003/0103027 A1 * 6/2003 Kim et al.
2003/0201989 A1 * 10/2003 Kim et al.

FOREIGN PATENT DOCUMENTS

JP 04-242945 A 8/1992

* cited by examiner

*Primary Examiner*—Regina Liang
*Assistant Examiner*—Jennifer T Nguyen
(74) *Attorney, Agent, or Firm*—Birch, Stewart, Kolasch & Birch, LLP

(57) ABSTRACT

An electro-luminescence display that is capable of being made into a small thickness and minimizing its length. In the electro-luminescence display, an electro-luminescence panel has a display area and a non-display area. Driving circuit boards apply driving signals to gate lines and data lines provided at the electro-luminescence panel. Tape carrier packages are connected between the driving circuit boards and the electro-luminescence panel in a planar state after the driving circuit boards were connected to the non-display area of the electro-luminescence panel.

6 Claims, 9 Drawing Sheets

ELECTRO-LUMINESCENCE DISPLAY

BACKGROUND OF THE INVENTION

1. Field of the Invention

This invention relates to an electro-luminescence display, and more particularly to an electro-luminescence display that is capable of being made having a small thickness and minimizing its length.

2. Description of the Related Art

An electro-luminescence display (ELD) is a display device taking advantage of an electro-luminescence (EL) phenomenon of generating a light by a voltage applied to a fluorescent material. Such an ELD is classified into an inorganic ELD and an organic ELD depending on its material and structure.

FIG. 1 shows a conventional inorganic ELD. Referring to FIG. 1, the inorganic ELD includes an upper insulating layer 34, a lower insulating layer 38, a luminescent layer 36 formed between the upper and lower insulating layers 34 and 38, and a transparent electrode 40 formed on the upper insulating layer 34, The transparent electrode 40 is arranged at the rear side of a glass substrate 41.

The upper and lower insulating layers 34 and 38 are made from a dielectric material. Thus, the upper and lower insulating layers 34 and 38 have desired capacitance values upon application of a voltage. The luminescent layer 36 is excited by electrons and is luminous, to thereby generate a visible light. The luminescent layer 36 is formed from a material such as ZnS or Mn, etc.

A rear electrode 32 is formed from a conductive material such as Al, etc. The rear electrode 32 receives a scanning pulse from a gate driving circuit (not shown) . The transparent electrode 40 is formed from a transparent conductive material such as indium-tin-oxide (ITO), etc, The transparent electrode 40 receives data from a data driving circuit (not shown). If a scanning pulse is applied to the rear electrode 32 and data is supplied to the transparent electrode 40, that is, if a voltage is applied between the rear electrode 32 and the transparent electrode 40, then holes are accelerated toward the rear electrode 32 while electrons are accelerated toward the transparent electrode 40. Such electrons and holes collide with each other at the center of the luminescent layer 36. The luminescent layer 36 generates a visible light when the electrons collide with the holes.

FIG. 2 shows a conventional organic ELD. Referring to FIG. 2, the organic ELD includes a metal electrode 42, a transparent electrode 48, a luminescent layer 45 formed between the metal electrode 42 and the transparent electrode 48, an electron transferring layer 43 and an electron carrying layer 44 formed between the luminescent layer 45 and the metal electrode 42, and a hole transferring layer 47 and a hole carrying layer 46.

The metal electrode 42 is made from a conductive material such as Al, etc. The metal electrode 42 receives a scanning pulse from a gate driving circuit (not shown). The transparent electrode 48 is formed from a transparent conductive material such as ITO, etc. The transparent electrode 48 receives data from a data driving circuit (not shown). If a scanning pulse is applied to the metal electrode 42 and data is supplied to the transparent electrode 48, then holes are accelerated toward the metal electrode 42 while electrons are accelerated toward the transparent electrode 48.

The electron-transferring layer 43 supplies electrons from the metal electrode 42 to the electron-carrying layer 44. The electron-carrying layer 44 accelerates the electrons from the electron-transferring layer 43 and supplies them to the luminescent layer 45. The hole transferring layer 47 supplies holes from the transparent electrode 48 to the hole-carrying layer 46. The hole-carrying layer 46 accelerates the hole from the hole-transferring layer 47 and supplies them to the luminescent layer 45.

The holes from the hole carrying layer 46 and the electrons from the electron-carrying layer 44 collide with each other at the center of the luminescent layer 45. The luminescent layer 45 generates a visible light when the electrons collide the holes.

In order to drive the inorganic ELD and the organic ELD, there is required a plurality of integrated circuits (IC's) for transferring a scanning pulse and a data supplied from the gate driving circuit and the data driving circuit. Such IC's is mounted by a chip on board (COB) system, a tape automated bonding (TAB) system or a chip on glass (COG) system. The TAB system is most widely used because it is possible to widen an effective area of a panel and the mounting process is simple. In the TAB system, the IC's are mounted onto a tape carrier package (TCP), which is connected among the gate driving circuit, the data driving circuit and an EL panel, Referring to FIG. 3, a TCP of TAB system includes a base film 22 mounted with an IC 14, and input/output pads 24 and 26 connected to input/output pins of the IC 14. The input/output pads 24 and 26 have two-layer structures in which a copper (Cu) is plated with a tin (Sn) so as to prevent an oxidation. Such a TCP 12 is arranged between a first input pad of the EL panel 30 and a gate driving circuit 6 as shown in FIG. 4. Further, the TCP 12 is arranged between a second input pad of the EL panel 30 and a data driving circuit 7. The input pads 24 of the TCP 12 are connected to the gate driving circuit 6 and the data driving circuit 7. The output pads 26 of the TCP 12 are connected to the EL panel 30. The first and second pads of the EL panel 30 are provided at a non-display area of the EL panel.

As shown in FIG. 5, the TCP 12 is secured to the non-display area of the EL panel 30 so as not to cover an effective display area of the EL panel 30 emitting a visible light. In this case, since the TCP 12 is secured to the non-display area of the EL panel 30 in a folded shape, it has a desired thickness "a" as shown in FIG. 6. In other words, the thickness of the ELD is increased by said desired thickness "a". In the mean time, since the driving circuits 6 and 7 should be secured to the non-display area of the EL panel 30, the IC 14 and the input pad 24 are formed to have a desired length "b". If the IC 14 and the input pad 24 have said desired length "b", then the ELD should be enlarged by the desired length "b" of the EL panel 30. In other words, it is difficult to make a conventional ELD having a small dimension due to the increase in thickness and length caused by the TCP 12.

SUMMARY OF THE INVENTION

Accordingly, it is an object of the present invention to provide an electro-luminescence display that is capable of being made having a small thickness and minimizing its length.

In order to achieve these and other objects of the invention, an electro-luminescence display according to an embodiment of the present invention includes an electro-luminescence panel having a display area and a non-display area; driving circuit boards for applying driving signals to gate lines and data lines provided at the electro-luminescence panel; and tape carrier packages connected between the driving circuit boards and the electro-luminescence panel in a planar state after the driving circuit boards were connected to the non-display area of the electro-luminescence panel.

In the electro-luminescence display, the driving circuit boards include a gate driving circuit for applying driving signals to the gate lines; and a data driving circuit for applying driving signals to the data lines. Also, the driving circuit boards include a plurality of output pads electrically connected to the tape carrier packages.

The electro-luminescence panel includes a plurality of input pads that are provided at the non-display area and electrically connected to the tape carrier packages.

The tape carrier packages include first pads connected to the output pads; and second pads connected to the input pads. Also, the tape carrier packages include a first tape carrier package arranged between the electro-luminescence panel and the gate driving circuit; and a second tape carrier package arranged between the electro-luminescence panel and the data driving circuit.

BRIEF DESCRIPTION OF THE DRAWINGS

These and other objects of the invention will be apparent from the following detailed description of the embodiments of the present invention with reference to the accompanying drawings, in which.

DETAILED DESCRIPTION OF THE PREFERRED EMBODIMENT

Figure 1:
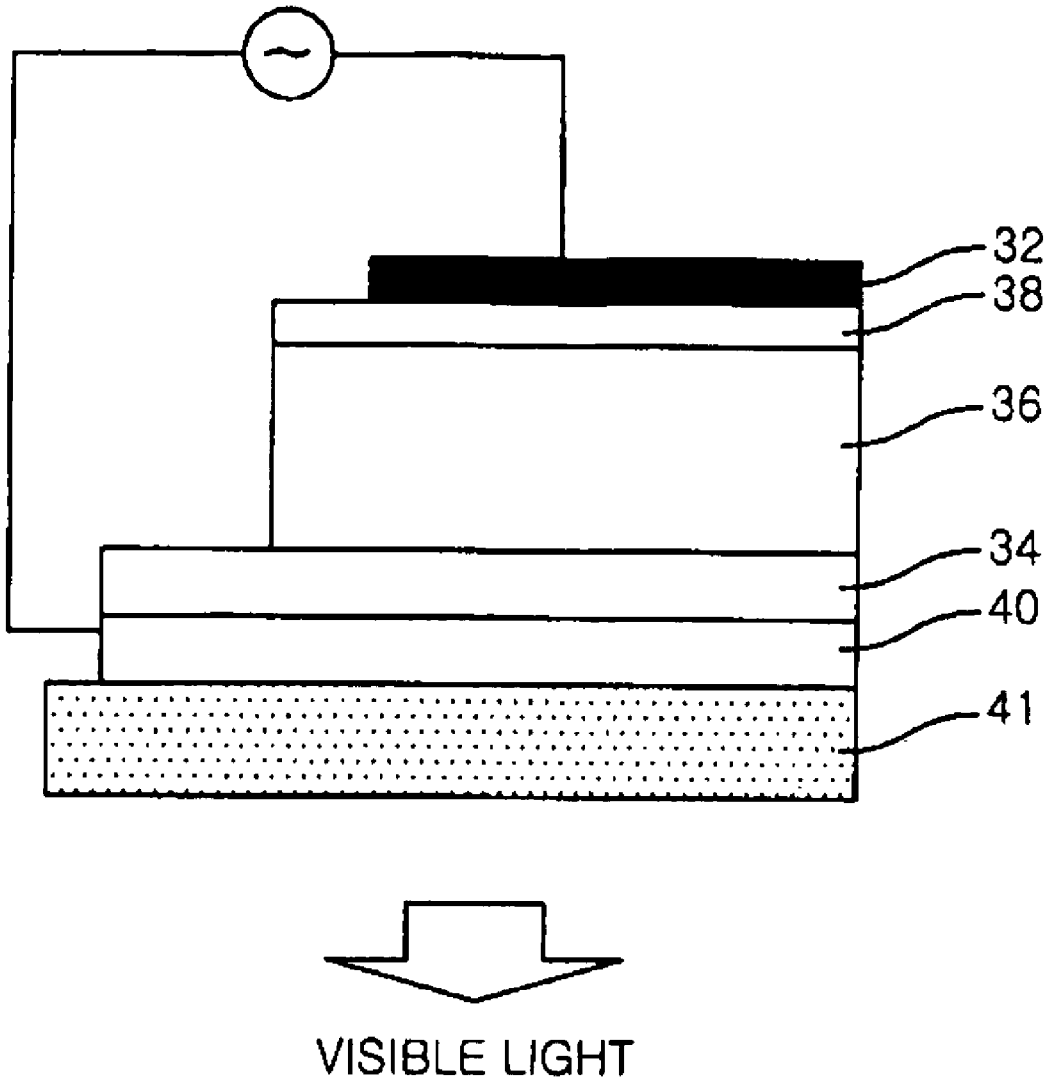
FIG. 1 CONVENTIONAL ART
FIG. 1 is a sectional view showing a structure of a conventional inorganic electro-luminescence display.
Figure 2:
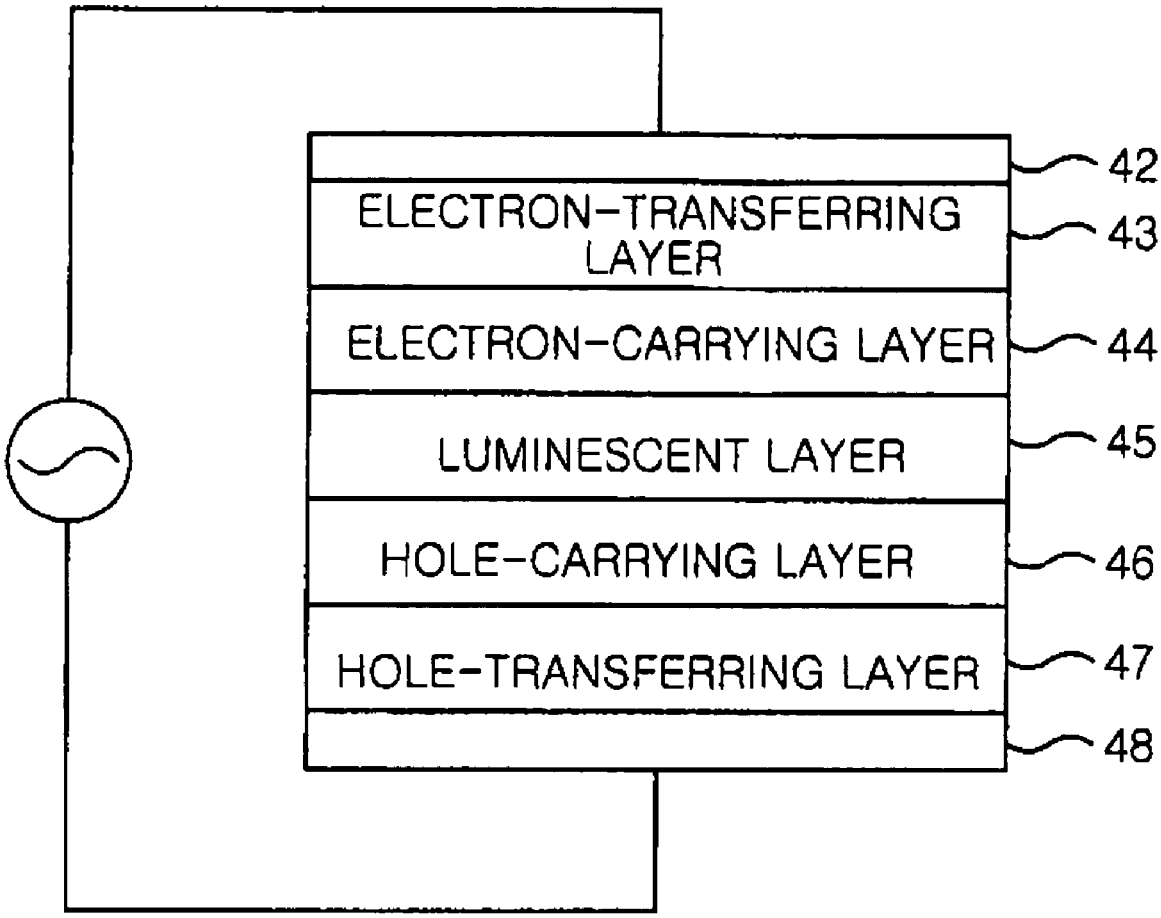
FIG.2 CONVENTIONAL ART
FIG. 2 is a sectional view showing a structure of a conventional organic electro-luminescence display.
Figure 3:
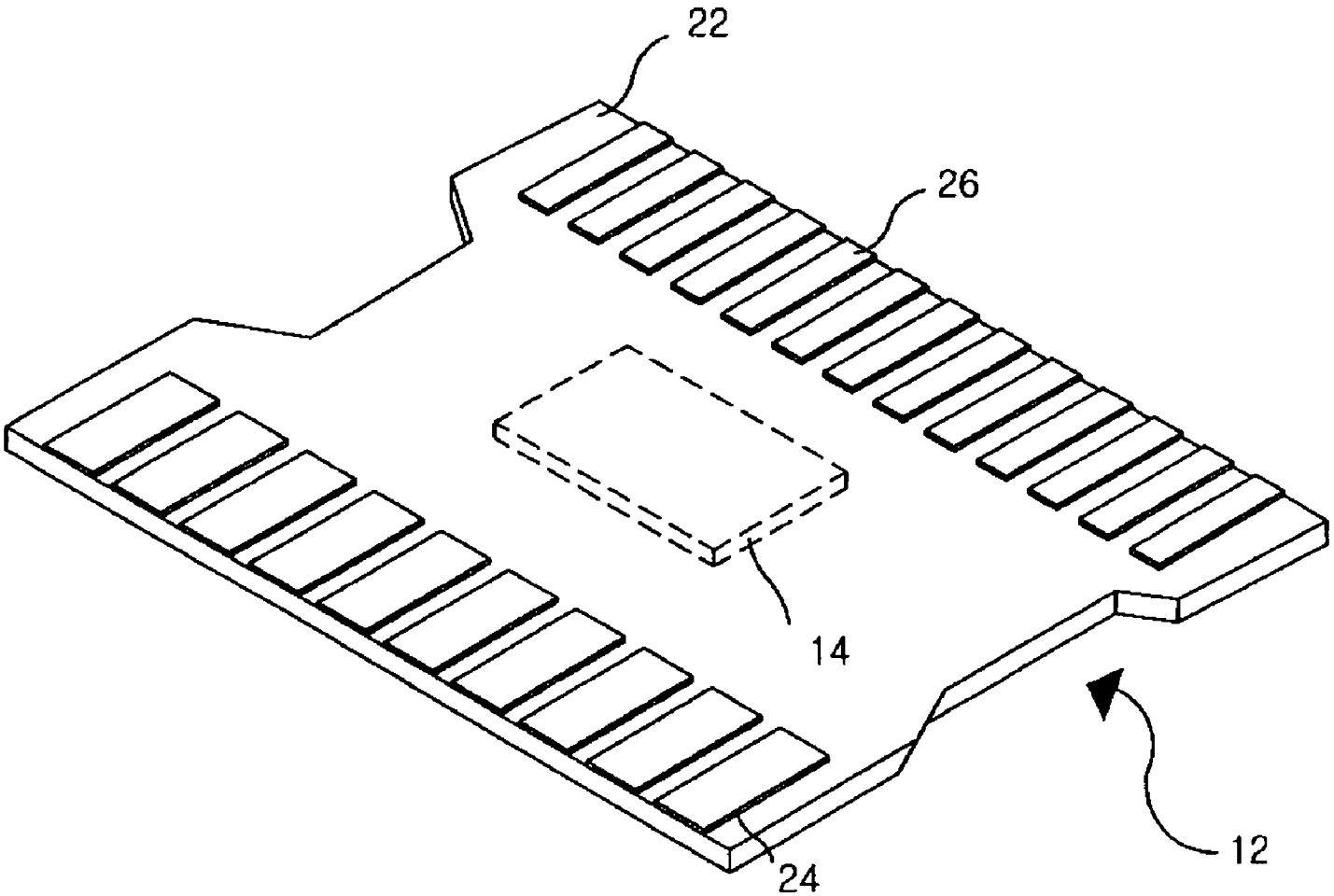
FIG.3 CONVENTIONAL ART
FIG. 3 is a perspective view showing a structure of a conventional tape carrier package.
Figure 4:
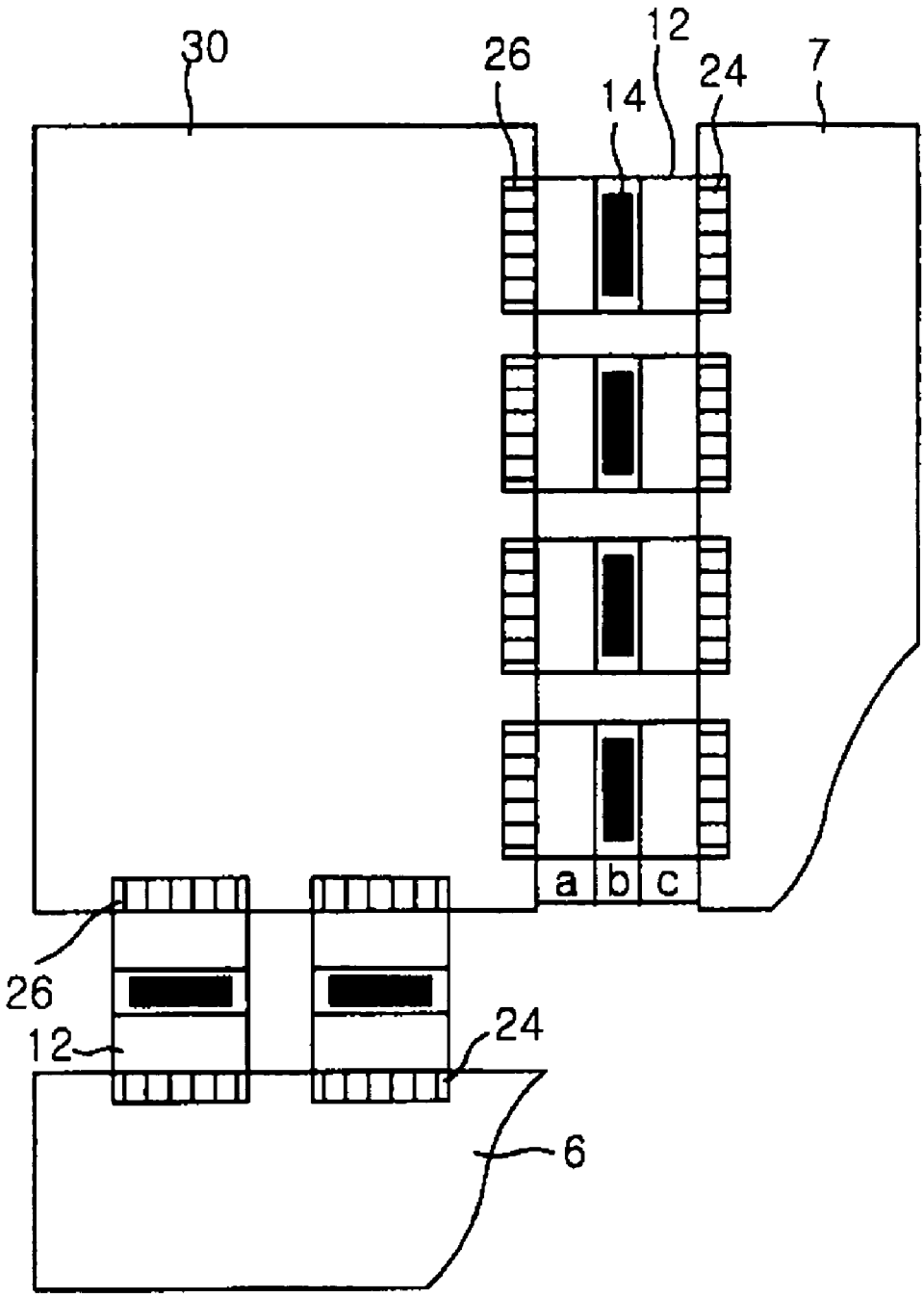
FIG.4 CONVENTIONAL ART
FIG. 4 illustrates a tape carrier package arranged between an organic electro-luminescence panel and driving circuits.
Figure 5:
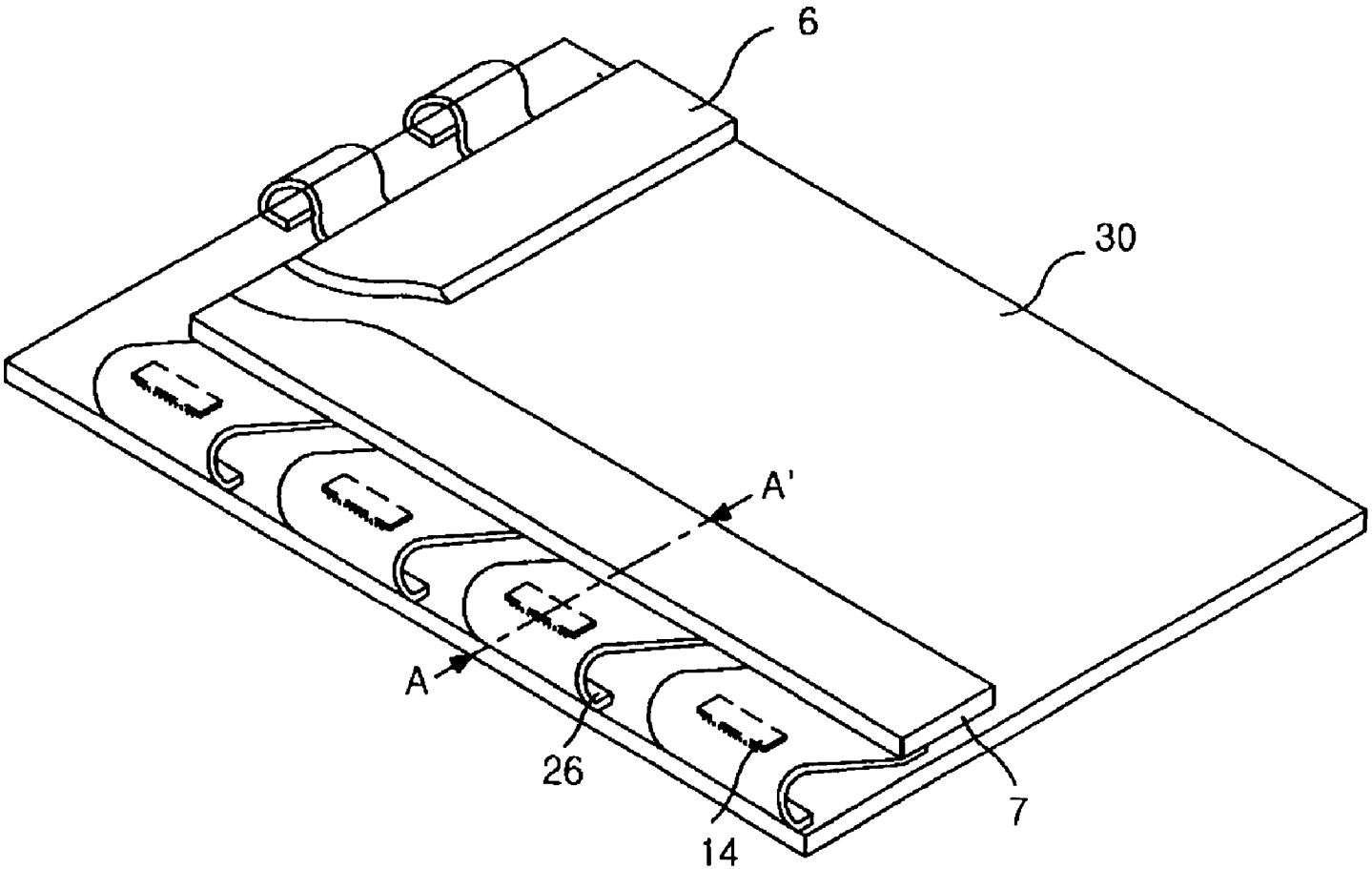
FIG.5 CONVENTIONAL ART
FIG. 5 illustrates a TCP in which the driving circuits shown in FIG. 4 are connected to the electro-luminescence panel.
Figure 6:
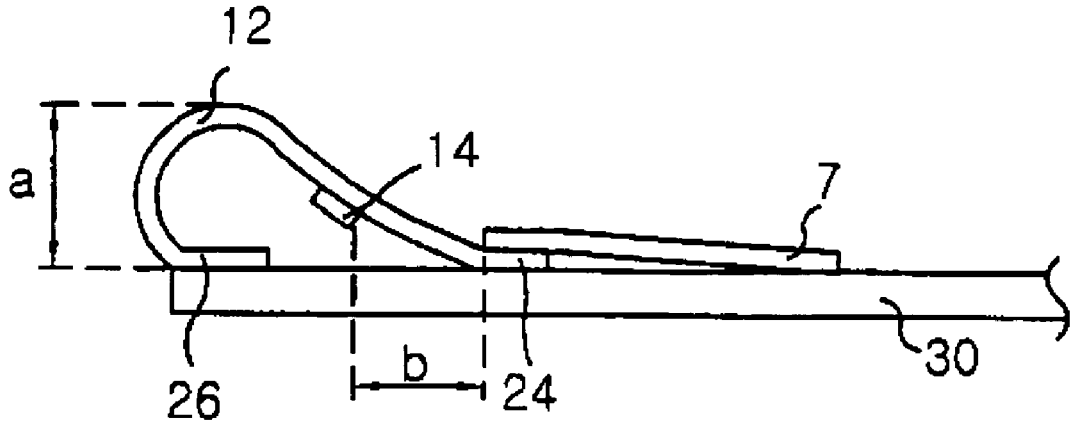
FIG.6 CONVENTIONAL ART
FIG. 6 is a sectional view taken along the A-A'line in FIG. 5.
Figure 7:
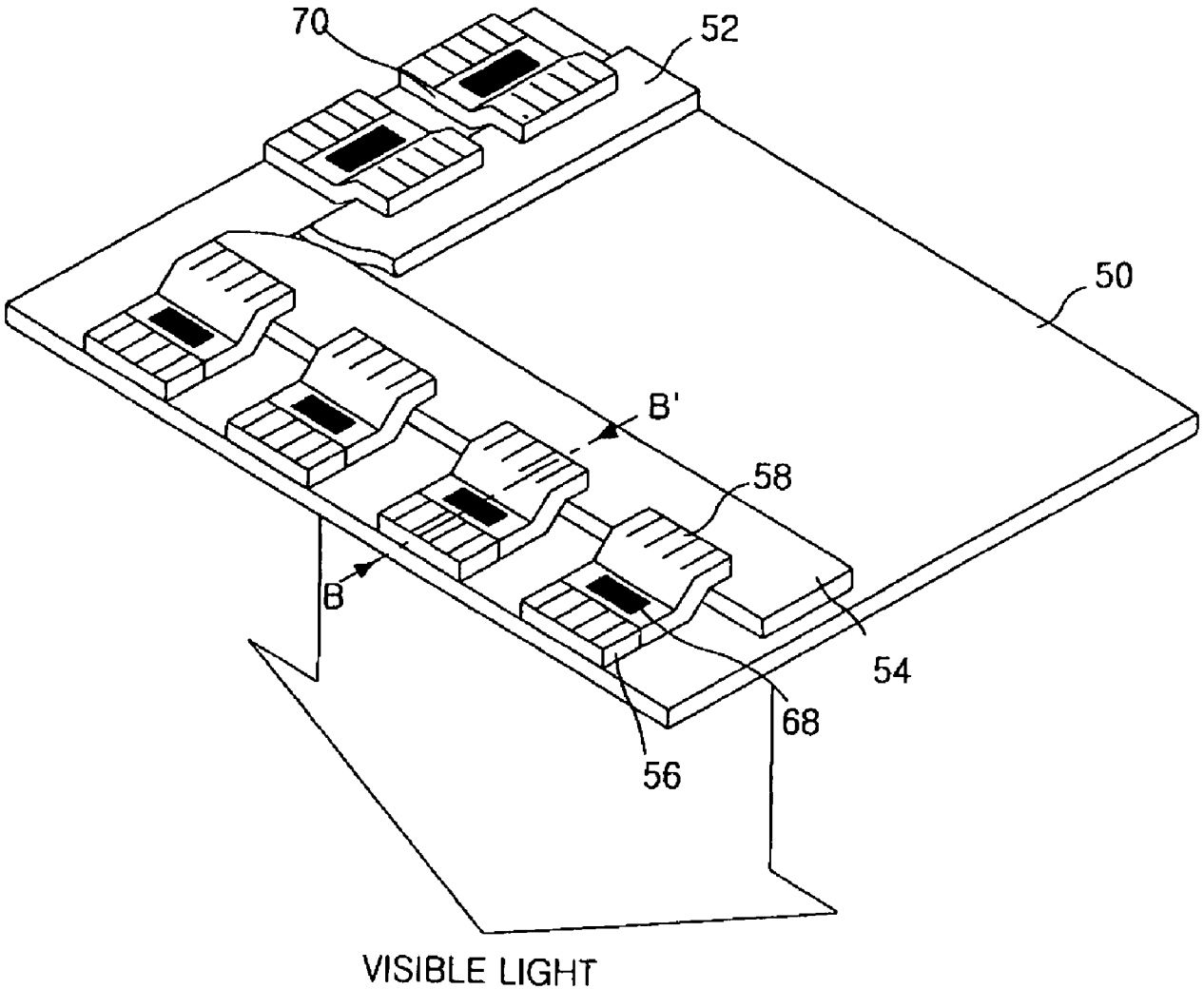
FIG. 7 is a perspective view showing a structure of an electro-luminescence display according to an embodiment of the present invention.
Figure 8:
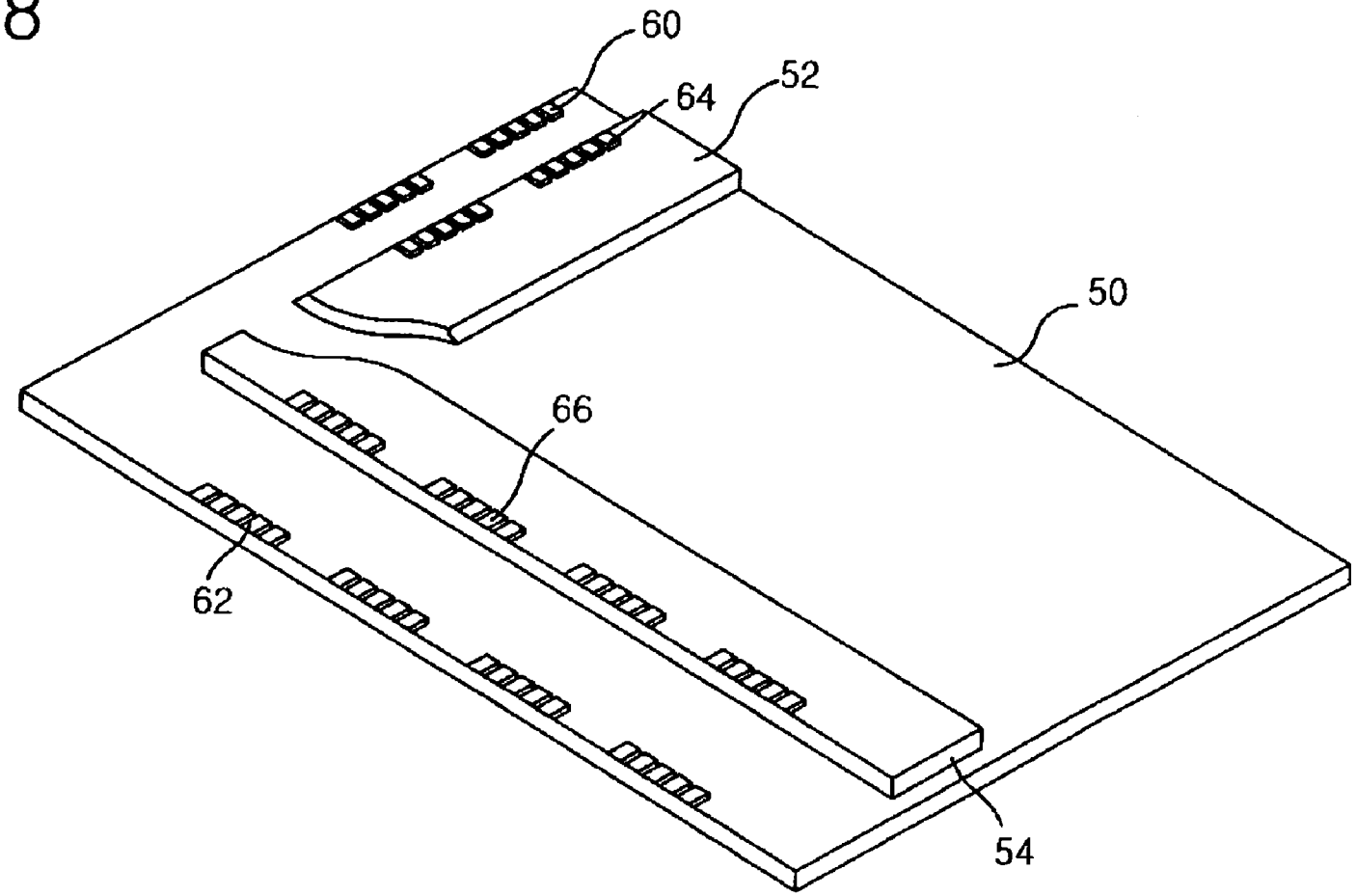
FIG. 8 illustrates the ELD of FIG. 7 in which the driving circuits are connected to the electro-luminescence panel.

Referring to FIG. 7, there is shown an electro-luminescence display (ELD) according to an embodiment of the present invention. The ELD includes a data driving circuit 54 for supplying a data, a gate driving circuit 52 for applying a scanning pulse, and an EL panel for receiving the data and the scanning pulse from the data driving circuit 54 and the gate driving circuit 52 to display a desired picture. As shown in FIG. 8, the data driving circuit 54 and the gate driving circuit 52 are connected to a non-display area of the EL panel 50. In this case, output pads of the data driving circuit 54 and the gate driving circuit 52 are connected to the non-display area of the EL panel 50. In other words, the output pads 66 and 64 are positioned at the upper portions of the data driving circuit 54 and the gate driving circuit 52.

The non-display area of the EL panel 50 is provided with first input pads 60 and second input pads 62. The first input pads 60 are electrically connected to gate lines provided at the interior of the EL panel 50. The first input pads 60 are formed in correspondence with the output pads 64 of the gate driving circuit 52. The second input pads 62 are electrically connected to data lines formed at the interior of the EL panel 50. The second input pads 62 are formed in correspondence with the output pads 66 of the data driving circuit 54.

The data driving circuit 54 and the gate driving circuit 52 are spaced at a desired distance from the first and second input pads 60 and 62 of the EL panel 50 such that a TCP 70 can be provided. The TCP 70 is connected between the EL panel 50 and the driving circuits 52 and 54 in a plane state after the driving circuits 52 and 54 are arranged. The input pads 58 of the TCP 70 are electrically connected to the output pads 64 and 66 of the driving circuits 52 and 54. The output pads 56 of the TCP 70 are electrically connected to the input pads 60 and 62 of the EL panel 50.

Figure 9:
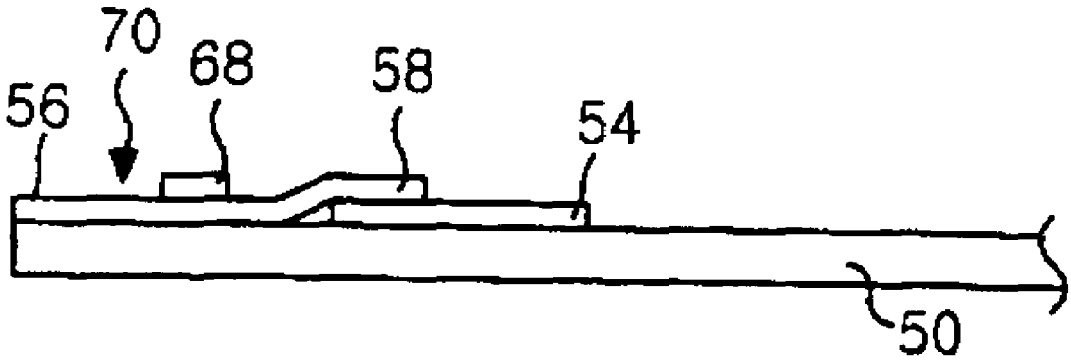
FIG. 9 is a sectional view taken along the B-B'line in Fig, 7.

Since such a TCP 70 is connected between the EL panel 50 and the driving circuits 52 and 54 in a planar state, its thickness can be minimized as shown in FIG. 9. When the TCP 70 is arranged with the EL panel 50 and the driving circuits 52 and 54, it is not folded like a conventional TCP. Thus, the thickness of the ELD can be minimized, to thereby provide an ELD having a small thickness. Furthermore, since the TCP 70 is connected to the driving circuits 52 and 54 in a planar state, the distance between an IC 68 and the input pad 58 can be minimized. Thus, the length of the EL panel 50 can be reduced in response to the reduced length between the TCP 70 and the IC 68.

As described above, according to the present invention, the TCP is connected between the driving circuits and the EL panel in a planar state. Accordingly, a thickness generated when the TCP is connected to the driving circuits and the EL panel can be minimized, so that it becomes possible to provide an ELD having a small thickness. Furthermore, the lengths of the IC's arranged at the TCP and the input pads can be minimized, so that it becomes possible to minimize the length of the ELD. In addition to, in the TAB system, the IC's are mounted onto a tape carrier package(TCP), which is connected among the input pads 58 and output pads 56.

Although the present invention has been explained by the embodiments shown in the drawings described above, it should be understood to the ordinary skilled person in the art that the invention is not limited to the embodiments, but rather that various changes or modifications thereof are possible without departing from the spirit of the invention. Accordingly, the scope of the invention shall be determined only by the appended claims and their equivalents.

What is claimed is:

1. An electro luminescence display, comprising:

an electro-luminescence panel having a first face including a display area and an opposite face having a non-display area;

driving circuit boards for applying driving signals to a gate line and a data line coupled directly to the opposite face having the non-display area of the electro-luminescence panel;

first electrical pads located on an inside perimeter of the opposite face of the electro-luminescence panel;

second electrical pads located on the driving circuit boards corresponding to and aligned with the first electrical pads located on the inside perimeter of the opposite face of the electroluminescence panel; and tape carrier packages contacting the first electrical pads on the opposite face of the electroluminescence panel and the second electrical pads located on the driving circuit boards, and being coupled directly to substantially the entire length of the opposite side of the electroluminescence panel located between the second electrical pads located on the driving circuit boards and the first electrical pads located on the electroluminescence panel in a planar state.

2. The electro-luminescence display according to claim 1, wherein the driving circuit boards include:

a gate driving circuit for applying driving signals to the gate lines; and a data driving circuit for applying driving signals to the data lines.

3. The electro-luminescence display according to claim 1, wherein each of the tape carrier packages has a first side for connecting the driving circuit boards to the electro-luminescence panel and a second side for holding a computer chip.

4. The electro-luminescence display according to claim 3, wherein a substantial portion of each of said tape carrier packages is in a common plane with said driving circuit boards.

5. The electro-luminescence display according to claim 3, wherein a substantial portion of each of said tape carrier packages having a first portion disposed in a common plane with said driving circuit boards and connected to the electro-luminescence panel.

6. The electro-luminescence display according to claim 5, wherein each of said tape carrier packages has a second portion disposed in a contiguous plane to the common plane of said electro-luminescence panel and said first portion.

* * * * *